United States Patent [19]

Kemble

[11] Patent Number: 4,763,388

[45] Date of Patent: Aug. 16, 1988

[54] MANUALLY OPERATED BAG CLOSURE DEVICE

[76] Inventor: Edward J. Kemble, 1181 NW. 5 Ct., Pompano Beach, Fla. 33060

[21] Appl. No.: 71,403

[22] Filed: Jul. 9, 1987

[51] Int. Cl.[4] ..... A44B 13/02; B65D 77/10

[52] U.S. Cl. ..... 24/30.5 R; 24/238; 24/239

[58] Field of Search ..... 24/30.5 R, 30.5 L, 238, 24/239, 115 G, 523, 524

[56] References Cited

U.S. PATENT DOCUMENTS

| | | | |
|---|---|---|---|
| Re. 31,096 | 12/1982 | Johnston | 24/238 |
| 345,923 | 7/1886 | Riggle | 24/239 |
| 1,438,264 | 12/1922 | Rygh . | |
| 2,482,625 | 9/1949 | Kunkel . | |
| 2,701,402 | 2/1955 | Foster | 24/239 |
| 3,212,153 | 10/1965 | Lynch . | |
| 3,350,753 | 11/1967 | Hester | 24/239 |
| 3,604,069 | 9/1971 | Jensen | 24/239 |
| 3,861,007 | 1/1975 | Silverman . | |
| 4,097,967 | 7/1978 | Conner, Jr. . | |
| 4,188,686 | 2/1980 | Baum . | |
| 4,277,866 | 7/1981 | Song . | |
| 4,394,791 | 7/1983 | Groth . | |
| 4,622,723 | 11/1986 | Krauss | 24/115 G |

FOREIGN PATENT DOCUMENTS

| | | | |
|---|---|---|---|
| 677224 | 8/1952 | United Kingdom | 24/238 |

*Primary Examiner*—Victor N. Sakran

*Attorney, Agent, or Firm*—John F. A. Earley; John F. A. Earley, III; P. Michael Walker

[57] ABSTRACT

A manually operated bag closure device comprises a housing, a plunger, a spring, and a key and is manually operable between a bag insertion position and a bag closure position. The device is manipulable with one hand to overcome the force of the spring and locate the plunger relative to the housing at the bag insertion position, the neck of the bag being inserted into the passage with the plunger then being released to allow the spring to relocate the plunger relative to the housing at the bag closure position to grasp the neck of the bag and close it airtight.

10 Claims, 2 Drawing Sheets

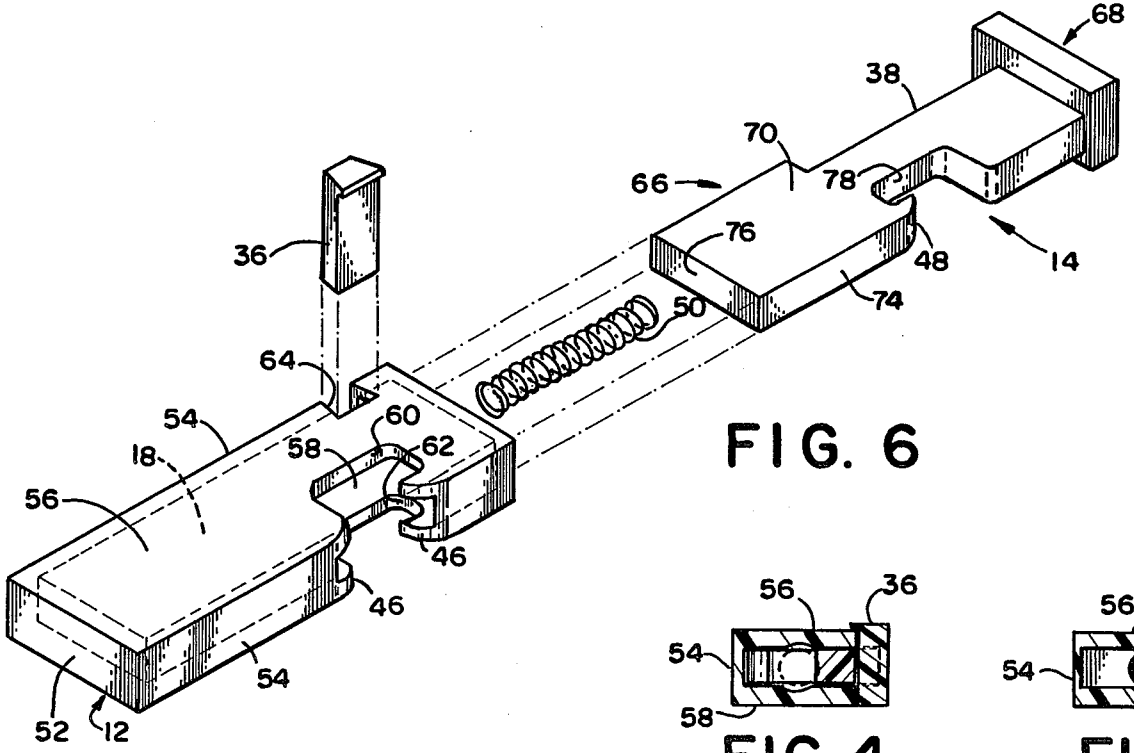
FIG. 6
FIG. 4
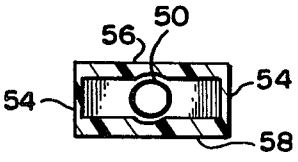
FIG. 5

MANUALLY OPERATED BAG CLOSURE DEVICE

BACKGROUND OF THE INVENTION

This invention relates to a bag closure device which is manually operable to facilitate closing bags made of compliant material, such as the type made of plastic utilized to distribute and store items of food, such as a loaf of bread. More particularly, this invention relates to such a device which is easily used in the home and inexpensive to manufacture.

Many different items are distributed to consumers in bags which are closed by gathering the compliant material thereof which is disposed circumferentially at the neck of the bag opening and retaining the gathered material and closing the bag with a wrapped wire tie or a plastic clip. As some of the items, like slices of bread, are taken periodically from the bag in the consumer's home, it is often desirable to store the remaining items in the same bag for later use. To do this, the bag must be regathered at its opening and the wire tie or plastic clip reapplied to retain the gathered material.

Although some very tricky techniques have been developed to reclose such bags, it is a cumbersome task at best and often presents severe problems which frustrate the consumer to such a degree that on occasion, all of the items are taken from the bag and stored in some other type of container. One very common technique is to dangle the bag with one hand while spinning it with the other hand to gather the material at the neck of the bag opening. While the bag is spinning, the wire tie or plastic clip is quickly retained in the spin hand and applied by the other hand about the gathered bag material at the neck. However, this technique is quite a bit more difficult than it sounds because the wire tie is very difficult to manipulate with one hand and the plastic clip often presents a problem when it is retained incorrectly in the spin hand or when the neck becomes too big due to excessive bag spin.

Many devices are known in the prior art for use in closing the open end of a flexible bag. Most of these devices apply pressure along a seam across the open end of the bag, such as with the clothespin like design utilized for the device disclosed and claimed in U.S. Pat. No. 4,394,791. However, such devices are inherently complex in design and consequently, high manufacturing costs are encountered therefor. Another such device is the heavy wire gauge hinge clamp such as that disclosed and claimed in U.S. Pat. No. 4,097,967. Because this clamp requires that the open end of the bag be threaded through the clamp opening prior to clamp activation, it is somewhat cumbersome to utilize. In devices of much greater sophistication and expense, the bag is fused closed with the application of heat or by cold flowing the bag material, as is disclosed and claimed in U.S. Pat. No. 4,188,686.

SUMMARY OF THE INVENTION

It is the general object of the present invention to provide a manually operated bag closure device which is easily manipulated with one hand.

It is a specific object of the invention to provide a manually operated bag closure device in accordance with the previously recited general object and which permits the neck of the bag opening to be inserted thereinto perpendicularly across the access axis of the bag opening.

It is another specific object of the present invention to provide a manually operated bag closure device in accordance with the previously recited objects and which operates to tightly gather the bag material at the neck of the opening about the access axis thereof in a substantially symmetric manner.

It is another specific object of the present invention to provide a manually operated bag closure device in accordance with the previously stated objects and which is designed for durability but is relatively inexpensive to manufacture.

The present invention accomplishes the previously recited objects with a housing and a plunger which are cooperatively configured and disposed to permit relative movement therebetween for locating the device at bag insertion and bag closure positions. The scope of this invention is limited only by the appended claims for which support is hereinafter set forth in the following specification and attached drawings that relate to a preferred embodiment of the invention.

DESCRIPTION OF THE DRAWINGS

FIG. 4 is a cross-sectional view through the bag closure device shown in FIG. 2 taken as indicated by the lines and arrows 4—4, and illustrates the depth to which the mortise and key penetrate through the side wall of the housing into the top and botto thereof;

FIG. 5 is another cross-sectional view through the bag closure device shown in FIG. 2 taken as indicated by the lines and arrows 5—5, and illustrates how the travel limiting block is compatibly configured for disposition within a housing cavity and includes a hole from which the spring extends; and FIG. 6 is an exploded view of the bag closure device shown in FIG. 1 and illustrates the grooves and slots on both the housing and the plunger which cooperate to create a passage through the device that is much greater in size at the bag insertion position than at the bag closure position.

DESCRIPTION OF THE PREFERRED EMBODIMENTS

Figure 1:
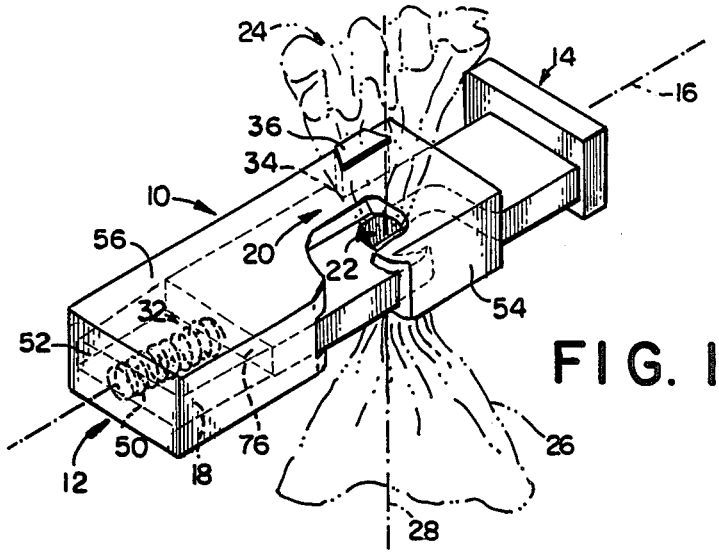
FIG. 1 is an isometric view showing the manually operated bag closure device of the invention with a bag disposed through the bag closure position thereof.

One preferred embodiment of the invention is illustrated in FIGS. 1 through 6, wherein the manually operated bag closure device 10 thereof is shown to include a housing 12 and a plunger 14 which are compatibly configured. The housing 12 is configured about a longitudinal axis 16 and has a cavity 18 extending thereinto from one longitudinal end thereof. The plunger 14 is compatibly configured with the cavity 18 and disposed therein for reciprocal movement along the longitudinal axis 16. A portion of the plunger 14 extends out of the housing 12 for controlling movement thereof into the cavity 18. Stop means 20 is included for retaining the plunger 14 within the housing 12.

As shown in FIG. 1, gathering means 22 is disposed on the housing 12 and plunger 14 for gathering the material, disposed circumferentially at the neck of an opening 24 into a bag 26, symmetrically about the access axis 28 into the bag 26. This gathering means 22 has a bag insertion position at one location of the plunger 14 relative to the housing 12, as shown in FIG. 3 and a bag closure position at another location therebetween, as shown in both FIGS. 1 and 2. From these figures, it may be seen that the bag insertion position exists at the end of plunger 14 movement into the housing 12, while the bag closure position exists at the end of the plunger 14 movement out of housing 12. As shown in FIG. 3, an access means or opening 30 is disposed through the device 10 for accessing the neck of the bag 26 into the gathering means 22 at the bag insertion position thereof, with the bag 26 passing thereinto in a direction perpendicularly across the bag access axis 28. Within the device 10, a bias means 32 is disposed for forcing the gathering means 22 toward the bag closure position.

When utilized to close the bag 26, the device 10 is manipulable with one hand to overcome the force of the bias means 32 and move the gathering means 22 to the bag insertion position, while dangling the bag 26 along the access axis 28 thereof, with the other hand. The neck of the bag is then inserted through the access means 30 into the gathering means 22, after which the force of the bias means 32 is released to move the gathering means 22 into the bag closure position. As is shown in FIG. 1, the neck of the bag is tightly gathered symmetically about the access axis 28, when the gathering means 22 moves from the bag insertion position to the bag closure position.

Of course, the hand controlling the device 10 is then free to assist the other hand in applying a wire tie or plastic clip (not shown) to retain the tightly gathered material at the neck of the bag opening 24, if so desired. When such a wire tie or plastic clip is so utilized, the device 10 is again manipulated to the bag insertion position where the bag 26 is removable therefrom, to make the device 10 available for closing other bags.

Figure 2:
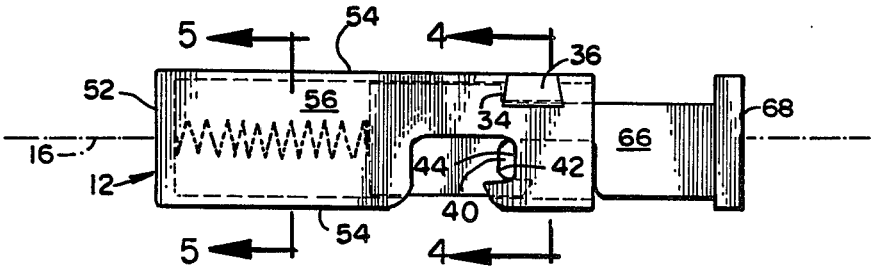
FIG. 2 is a plan view looking down on the bag closure device of FIG. 1 but without the bag being disposed
Figure 3:
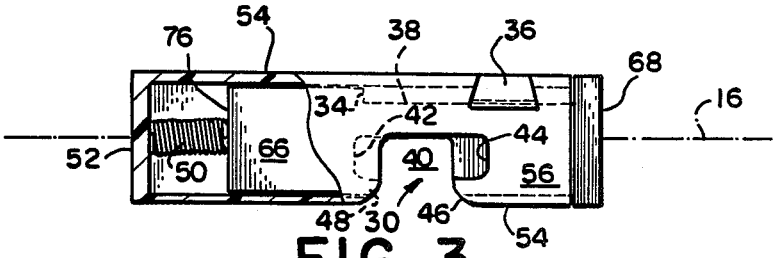
FIG. 3 is a plan view similar to that of FIG. 2 but with the bag closure device shown in the bag insertion position thereof and having a portion thereof cut away to show a spring which is retained therein by a block that limits travel of the plunger in one direction.

Although the means 20 for retaining the plunger 14 within the housing 12 may be implemented in many different ways within the scope of this invention, the particular implementation utilized is best illustrated in FIGS. 1, 2 and 3 wherein a shoulder 34 is disposed on the plunger 14 which comes to bear against a key 36 at the bag closure position of the device 10. The shoulder 34 is created by a recessed portion 38 on the plunger 14 which extends in a direction parallel to the longitudinal axis 16 out of the cavity 18 for at least the distance of plunger movement between the bag insertion and bag closure positions. The key 36 is fixedly disposed through the housing 12 and is mortised therein as a tenon having a dovetailed, cross-sectional configuration in the preferred embodiments of the device 10.

The gathering means 22 is implemented with a passage 40 through both the housing 12 and the plunger 14 which has a symmetrical configuration about an axis perpendicular to the longitudinal axis 16 at any position of the device 10, as is best illustrated in FIGS. 2 and 3. Separate wall portions 42 and 44 of the passage 40 are disposed on the plunger 14 and housing 12 respectively, and move cooperatively in opposite directions along the longitudinal axis 16 to greatly constrict the opening of the passage 40 about that axis of symmetry at the bag closure position. In the preferred embodiment of the device 10, the wall portions 42 and 44 are configured with a cylindrical contour.

Grooves 46 and 48 having substantially identical configurations, are disposed through the housing 12 and plunger 14 respectively, into the gathering means 22 at the bag insertion position of the device 10 to implement the accessing means 30, as shown in FIGS. 3 and 6. These grooves 46 and 48 pass through the device into the gathering means 22 in a direction perpendicular to both the longitudinal axis 16 and the bag access axis 28. As best illustrated in FIG. 6, the wall of the grooves 46 and 48 may be contoured to provide a lead for guiding the neck of the bag opening 24 into the gathering means 22.

To implement the bias means 32, a spring 50 is disposed between the housing 12 and plunger 14 to apply force therebetween for relative movement thereof along the longitudinal axis 16 toward the bag closure position. Although other spring arrangements and types of springs may be utilized, the coil spring illustrated in FIGS. 1 and 6 is utilized in the preferred embodiments of the invention.

The specific design and/or overall configuration of the device 10 illustrated in FIGS. 1–6 may be varied within the scope of the invention to incorporate other features thereinto or to accommodate particular fabrication techniques. For instance, a gripping feature could be incorporated by disposing "finger ears" (not shown) exteriorly on the housing 12 in a manner similar to a hypodermic syringe. Another possibility is for the device 10 to have an overall configuration that is generally cylindrical and thereby accommodate the fabrication thereof with rod and tube stock materials.

For the generally rectangular configuration illustrated for the device in FIGS. 1-6, the housing 12 and plunger 14 thereof may either be molded or fabricated from sheet stock materials, such as plexiglass. Construction details for both the housing 12 and plunger 14 are best illustrated in FIG. 6. Five walls are joined on the hollow, oblong housing 12, with one wall 52 being disposed at one longitudinal end thereof to serve as the bottom of the cavity 18. A pair of side walls 54 otherwise separate a top wall 56 and a bottom wall 58 which have a greater width horizontally across the longitudinal axis 16 than do the side walls 54 vertically across that axis, as best shown in FIG. 4. Slots 60 and 62 are disposed through the top and bottom walls 56 and 58 respectively, and are the contribution made by the housing 12 to the passage 40 through the device 10. These slots 60 and 62 are disposed along the longitudinal axis 16 and aligned thereacross along a vertical axis (not shown) perpendicular thereto, with their configurations being symmetrical about that vertical axis. The grooves 46 are disposed into the slots 60 and 62 across and through one of the side walls 54 and portions of the top and bottom walls 56 and 58. A dovetailed mortise 64 for the key 36 is disposed across and through the other side wall 54, with portions thereof extending into the top and bottom walls 56 and 58.

The plunger 14 includes a body 66 and a head 68 which remains external to the housing 12 and appears to be an end wall thereof when the device 10 is located in the bag insertion position, as shown in FIG. 3. The body 66 is compatibly configured with the housing cavity 18, having top and bottom surfaces 70, a pair of side surfaces 74, and an end surface 76 disposed thereon in corresponding relationship respectively, to the top and bottom walls 56 and 58, the side walls 54, and the end wall 52 on the housing 12. The recessed portion 38 is disposed as part of one side surface 74. As the plunger 14 contribution to the passage 40, a slot 78 is disposed through both the top and bottom surfaces 70, at a location along the longitudinal axis 16 and has a symmetrical configuration about a vertical axis (not shown) perpendicular thereto. The symmetrical configuration of the slot 78 about its vertical axis is substantially the same as the symmetrical configuration of the housing slots 60 and 62 about their vertical axis. The groove 48 is disposed across and through the other side surface 74, into the slot 78.

As shown in FIG. 1, the spring 50 is disposed along the longitudinal axis 16 between the housing end wall 52 and the plunger end surface 76 to exert a force which tends to locate the plunger 14 relative to the housing 12 at the bag closure position.

From the foregoing description it should be apparent that explanations are provided therein as to how the previously stated objects of the invention are accomplished. As explained, the manually operated bag closure device of the invention is easily manipulated with one hand because the grooves and slots on the housing and plunger cooperate at the bag insertion position of the device to permit insertion of the bag neck into the gathering means in a direction perpendicularly across the access axis into the bag opening. From the bag insertion position, the device is self-actuating to tightly gather the bag material at the neck about the access axis thereof in a substantially symmetric manner, while returning the housing and plunger to the bag closure position of the device. Because the housing and plunger are essentially the only parts which move relative to each other and that movement is reciprocal within the housing, the device is extremely durable. Except for the spring, all of the parts in the device can be either molded or made from stock materials, with very little machining and/or assembly thereof being necessary and therefore, the device is relatively inexpensive.

Key 36 is trapezoidal in cross section to fit in mortise 64, and is provided with a shoulder 37 that contacts the upper surface of top wall 56 to help hold key 36 in place in mortise 64 and to prevent key 36 from sliding completely through and out of mortise 64.

I claim:

1. A manually operated bag closure device for closing the opened end of a bag made compliant material and comprising:

a housing having a longitudfinal axis and a cavity extending thereinto from one longitudinal end thereof;

a plunger compatibly configured with said housing cavity and disposed therein for reciprocal movement along said longitudinal axis, said plunger having a portion thereof extending from said housing cavity for controlling said movement thereinto;

cooperative means on said housing and said plunger for gathering material disposed circumferentially at the neck of the bag opening symmetrically about the access axis into the bag, said gathering means having a bag insertion position at the end of said reciprocal movement where said plunger reaches maximum travel into said housing cavity and a bag closure position at the end of said reciprocal movement where said plunger reaches maximum travel out of said housing cavity;

means disposed through said device for accessing the neck of the bag opening therethrough into said gathering means at said bag insertion position thereof, with the bag passing thereinto in a direction perpendicularly across the bag access axis;

bias means for forcing said gathering means on said plunger to said bag closure position; and means for retaining said plunger within said housing cavity against the force of said bias means, said device being manipulable with one hand to overcome the force of said bias means in locating said gathering means at said bag insertion position while dangling the bag along the access axis thereof with the other hand, and the neck of the bag then being insertible through said access means into said gathering means with said bias means being releasable to move said gathering means into said bag closure position at which the bag opening is closed with the neck thereof tightly gathered symmetrically about the access axis thereinto.

2. The bag closing device of claim 1 wherein said gathering means includes a passage through both said plunger and said housing, said passage having a symmetrical configuration about an axis perpendicular to said longitudinal axis at any position of said gathering means and having separate wall portions thereof disposed on said plunger and said housing which move cooperatively in opposite directions along said longitudinal axis to greatly constrict the opening of said passage about said axis of symmetry at said bag closure position.

3. The bag closing device of claim 4 wherein said separate wall portions on said plunger and said housing are cylindrically contoured.

4. The bag closing device of claim 1 wherein said accessing means into said gathering means is a groove through said device with said housing and said plunger relatively located at said bag insertion position, said groove being disposed into said gathering means through both said housing and said plunger in a direction perpendicular to both said longitudinal axis and the intended disposition of the bag access axis in said gathering means.

5. The bag closing device of claim 4 wherein the walls of said groove are contoured to provide a lead for guiding the neck of the bag opening into said gathering means.

6. The bag closing device of claim 1 wherein said bias means is a spring disposed between said housing and said plunger to apply force therebetween for relative movement thereof toward the bag closure position.

7. The bag closing device of claim 1 wherein said plunger retaining means includes a bearing shoulder and a bearing key, said plunger having a recessed portion thereon to create said shoulder, said recessed portion extending from said shoulder in the direction out of said housing cavity and parallel to said longitudinal axis for at least the distance of plunger movement in said housing between said bag insertion and bag closure positions, said key being fixedly disposed through said housing to bear against said shoulder when said plunger is located relative to said housing at said bag closure position.

8. A manually operated bag closure device for closing the opened end of a bag made of compliant material and comprising:

a housing having a longitudinal axis and a cavity extending thereinto from one longitudinal end thereof;

a plunger compatibly configured with said housing cavity and disposed therein for reciprocal movement along said longitudinal axis, said plunger having a portion thereof extending from said housing cavity for controlling said movement thereinto;

means for retaining said plunger within said housing cavity;

cooperative means on said housing and said plunger for gathering material disposed circumferentially at the neck of the bag opening symmetrically about the access axis into the bag, said gathering means having a bag insertion position at the end of said reciprocal movement where said plunger reaches maximum travel into said housing cavity and a bag closure position at the end of said reciprocal movement where said plunger reaches maximum travel out of said housing cavity;

means disposed through said device for accessing the neck of the opening therethrough into said gathering means at said bag insertion position thereof, with the bag passing thereinto in a direction perpendicularly across the bag access axis;

bias means for forcing said gathering means to said bag closure position, said device being manipulable with one hand to overcome the force of said bias means in locating said gathering means at said bag insertion position while dangling the bag along the access axis thereof with the other hand, and the neck of the bag then being insertible through asid access means into said gathering means with said bias means being releasable to move said gathering means into said bag closure position at which the bag opening is closed with the neck thereof tightly gathered symmetriclaly about the access axis thereinto;

said plunger retaining means including a bearing shoulder and a bearing key, said plunger having a recessed portion thereon to create said shoulder, said recessed portion extending from said shoulder in the direction out of said housing cavity and parallel to said longitudinal axis for at least the distance of plunger movement in said housing between said bag insertion and bag closure positions, said key being fixedly disposed throug said housing to bear against said shoulder when said plunger is located relative to said housing at said bag closure position.

9. The bag closing device of claim 8 wherein said key is mortised in said housing as tenon which has a dovetailed cross-sectional configuration.

10. A device for closing the open end of a bag made of compliant material, which is manually operable between a bag insertion position and a bag closure position, comprising:

a hollow, oblong housing having a longitudinal axis and five walls, with one longitudinal end thereof being an opening into a cavity which extends along said longitudinal axis substantially to a wall at the other longitudinal end, said other walls being a top wall and a bottom wall separated across said longitudinal axis by a pair of side walls, said top and bottom walls having a greater width horizontally across said longitudinal axis than the width of said side walls vertically across that axis, said bag insertion and bag closure positions being provided for on said housing with a groove disposed across and through one of said side walls into individual slots disposed through each of said top and bottom walls, said slots being aligned across said longitudinal axis in a direction perpendicular to that axis and being located therealong with a symmetrical configuration thereabout to include both said bag insertion and bag closure positions, said other side wall having a dovetailed mortise disposed therethrough to extend into said top and bottom walls;

a plunger having a body and a head, said body being compatibly configured with said housing cavity for slidable disposition therein and having top and bottom surfaces, a pair of side surfaces and an end surface disposed thereon in corresponding relationship respectively to said top and bottom walls, said side walls and said end wall on said housing, one of said side surfaces having a portion thereof recessed between a shoulder and said head, while a groove is disposed across and through said other side surface into a slot disposed through said top and bottom surfaces, with said plunger groove being substantially of identical configuration to said housing grooves and locating in alignment therewith when said device is in said bag insertion position;

a coil spring disposed along said longitudinal axis between said end wall of said housing and said end surface of said plunger body, said spring being compressible to locate said plunger relative to said housing at said bag insertion position and exerting a force which tends to locate said plunger relative to said housing at said bag closure position;

a key having a compatible dovetailed cross-sectional configuration to that of said housing mortise and being pressed thereinto while said plunger is located relative to said housing at said bag insertion position, said plunger body being retained in said housing cavity by said key when said plunger body shoulder comes to bear thereagainst at said bag closure position due to the force of said spring against said plunger, said device being manipulable with one hand to overcome the force of said spring in locating said plunger relative to said housing at said bag insertion position, while dangling the bag along the access axis thereinto with the other hand, the opening neck of the bag then being insertible through said grooves in said housing side wall and said plunger body side surface into said housing slots and said plunger body slot with said plunger then being releasable to allow said spring to relocate said plunger relative to said housing at said bag closure position where the material disposed circumferentially on the neck of the bag opening would be gathered symmetrically about the access axis into the bag opening.

* * * * *